US011508269B2

(12) United States Patent
Evans

(10) Patent No.: US 11,508,269 B2
(45) Date of Patent: Nov. 22, 2022

(54) PORTABLE, SELF-ILLUMINATING TRAFFIC SIGN

(71) Applicant: Michael J. Evans, Orland Park, IL (US)

(72) Inventor: Michael J. Evans, Orland Park, IL (US)

( * ) Notice: Subject to any disclaimer, the term of this patent is extended or adjusted under 35 U.S.C. 154(b) by 0 days.

(21) Appl. No.: 17/449,315

(22) Filed: Sep. 29, 2021

(65) Prior Publication Data

US 2022/0020301 A1 Jan. 20, 2022

Related U.S. Application Data

(63) Continuation-in-part of application No. 16/671,512, filed on Nov. 1, 2019, now Pat. No. 11,158,217.

(60) Provisional application No. 62/766,829, filed on Nov. 5, 2018.

(51) Int. Cl.

| | |
|---|---|
| ***G09F 13/16*** | (2006.01) |
| ***F21V 23/04*** | (2006.01) |
| ***E01F 9/615*** | (2016.01) |

(52) U.S. Cl.

CPC ..... *G09F 13/16* (2013.01); *E01F 9/615* (2016.02); *F21V 23/04* (2013.01)

(58) Field of Classification Search

CPC ..... G09F 2013/222; G09F 13/16; G09F 15/0037; G09F 15/0056; G09F 21/02; E01F 9/604; E01F 9/615; E01F 9/617

See application file for complete search history.

(56) References Cited

U.S. PATENT DOCUMENTS

| | | | | |
|---|---|---|---|---|
| 5,276,424 | A | 1/1994 | Hegemann | |
| 5,493,292 | A | 2/1996 | Fanslow et al. | |
| 5,755,051 | A * | 5/1998 | Zumbuhl | G09F 21/02 40/607.04 |
| 5,986,576 | A | 11/1999 | Armstrong | |
| 6,104,313 | A | 8/2000 | Boyd, II | |
| 6,134,819 | A * | 10/2000 | McClain | G09F 7/20 248/219.2 |
| 6,134,820 | A * | 10/2000 | Martinez | G09F 7/08 116/63 P |
| 6,147,623 | A | 11/2000 | Rippen | |
| 6,204,777 | B1 | 3/2001 | Lyons | |
| 6,363,641 | B1 | 4/2002 | Martinez | |
| 6,796,062 | B1 * | 9/2004 | deKoevend | G09F 7/00 116/63 P |
| D498,162 | S * | 11/2004 | Evans | D10/109.1 |
| 9,305,472 | B1 * | 4/2016 | Pitts | G09F 13/22 |
| 2002/0053152 | A1 | 5/2002 | Collins | |

(Continued)

*Primary Examiner* — Gary C Hoge

(74) *Attorney, Agent, or Firm* — Green, Burns & Crain, Ltd.

(57) ABSTRACT

A portable, self-illuminating traffic sign having a sign face with two opposite sides. One side indicates a first traffic signal, and the other side indicates a second traffic signal. Light assemblies are attached to each side of the sign. The light assemblies emit light that may match the predominant color of one of the sides of the sign. A battery may be disposed in a pole that connects to the sign. A handlegrip allows for the sign to be held and provides a switch to allow for the lights to be selectively turned on and off. The light assemblies are disposed within collar assemblies so as to reduce, or prevent, light emitted from the light assemblies reflecting off of the sign faces.

20 Claims, 4 Drawing Sheets

(56) References Cited

U.S. PATENT DOCUMENTS

| | | | | |
|---|---|---|---|---|
| 2003/0033739 | A1 | 2/2003 | Tingle | |
| 2009/0077848 | A1* | 3/2009 | Dicke | G09F 21/02 116/63 P |
| 2012/0216436 | A1* | 8/2012 | Adair | G08G 1/07 40/559 |
| 2015/0121731 | A1* | 5/2015 | Flaming | G09F 15/005 40/586 |
| 2019/0103045 | A1* | 4/2019 | Vugts | G09F 23/0082 |

* cited by examiner

PORTABLE, SELF-ILLUMINATING TRAFFIC SIGN

RELATED APPLICATIONS

This application is a continuation in part of U.S. Ser. No. 16/671,512 filed on Nov. 1, 2019, which claims priority to U.S. Provisional Application Ser. No. 62/766,829 filed on Nov. 5, 2018, the entireties of both of which are incorporated herein by reference.

FIELD OF THE DISCLOSURE

The present invention relates to a portable, hand-held traffic control sign and in particular, to a portable, hand-held sign for directing motor vehicle traffic.

BACKGROUND OF THE INVENTION

Many road construction situations require signs to convey information and instructions to motorists. Often it is necessary for a worker to hold such a sign for extended periods of time, frequently in changing weather and lighting conditions.

Currently, a traffic control worker may use an octagonal sign with a conventional stop sign indicator on one side and a conventional slow sign indicator on a second side. While such a sign may be effective during the daytime or during times with good visibility, such a sign may be inadequate at night or in poor visibility and changing weather conditions. Specifically, due to the reflective material of the sign, external lights directed at the sign reflect off the sign but obscure the traffic signal, and thus do not provide motorists with a clear indication of what traffic signal (stop or slow) is being indicated. Additionally, the need to use external lights can be a problem in remote or other areas.

More recently, attempts have been made to address this problem with signs that include a flashing light on one or more of the sides of the sign. While this may draw a motorist's attention to the sign, it still does not provide a clear and effective indication of what traffic signal is being indicated to the motorist.

Therefore, there is a need for a traffic control sign that addresses one or more of these shortcomings.

SUMMARY OF THE INVENTION

The present invention provides a hand-held traffic sign that has enhanced visibility, is easy to hold, is portable, and has long battery life. Additionally, in various aspects to enhance the visibility and more clearly indicate the appropriate traffic signal, the present sign utilizes lights that correspond to the traffic signal (e.g., red for stop, yellow for slow). The present invention allows for the sign legends to be clearly visible even when the lights emit light.

Accordingly, in one or more aspects, the present invention may be broadly characterized as providing a portable, self-illuminating traffic sign with: a sign head having a first and second side and made of a reflective panel having a color for visually indicating a traffic signal and additionally having an aperture; a first collar extending from the first side of the panel, about or surrounding the aperture, and having an outermost edge furthest from the sign head; a second collar extending from the second side of the panel, about the aperture, and having an outermost edge furthest from the sign head; a first light assembly disposed on the outermost edge of the first collar; a second light assembly disposed on the outermost edge of the second collar; and a handle attached to the reflective panel having a switch configured to selectively activate at least one of the first light assembly, the second light assembly, or both.

The portable, self-illuminating traffic sign may also include: a base disposed on a pole and located opposite the sign head; and a battery electrically connected to at least one of the first light assembly, the second light assembly, or both. The battery may be disposed at least eight inches above the base. A connection between the handle and the pole with the battery may be waterproof.

Both the first light assembly and the second light assembly may comprise light emitting diodes.

The first light assembly and the second light assembly may generate different color light.

The first light assembly and the second light assembly, when activated, flash sixty times per minute.

In another aspect, the present invention may be generally characterized as providing a portable, self-illuminating traffic sign with: a sign head made of a reflective panel having a first side comprising a first traffic sign with a first predominant color and a second side comprising a second traffic sign different from the first traffic sign with a second predominant color different from the first predominant color; a first pair of light assemblies, each disposed on a first collar extending from the first face; a second pair of light assemblies, each disposed on a second collar extending from the second face; and, a handle attached to the reflective panel.

The handle may include a switch having a first position, second position, and a third position, wherein the switch is configured to activate the first light assembly when in the first position, activate the second light assembly when in the second position, and activate neither the first light assembly nor the second light assembly in the third position. The switch may be connected to a battery disposed in a pole, the pole having a base at one end, and the sign head disposed at a second end of the pole. The pole may include two poles that are selectively connected.

The first pair of light assemblies may generate light corresponding to the first predominant color, and the second pair of light assemblies may generate light corresponding to the second predominant color. Both the first pair of light assemblies and the second pair of light assemblies may flash sixty times per minute, when activated.

The first pair of light assemblies and the second pair of light assemblies may include light emitting diodes.

The reflective panel may have a first aperture and a second aperture, wherein a first light assembly of the first pair of light assemblies and a third light assembly of the second pair of light assemblies are disposed on either side of the first aperture, such that the first light assembly and the third light assembly face in opposite directions; and wherein a second light assembly of the first pair of light assemblies and a fourth light assembly of the second pair of light assemblies are disposed on either side of the second aperture such that the second light assembly and the fourth light assembly face in opposite directions. Wiring for the first light assembly and the second light assembly may be located on the second face and may be covered by a cap comprising the second predominant color.

In another aspect, the present invention may be broadly considered as providing a portable, self-illuminating traffic sign having: a sign head made of a reflective panel having a first side comprising a first traffic sign with a first predominant color and a second face comprising a second traffic sign different from the first traffic sign with a second predominant color different from the first predominant color;

a first pair of light assemblies, each light assembly disposed on a collar extending away from the first face; a second pair of light assemblies, each light assembly disposed on a collar extending away from the second face; and, a first pole having a first end attached to the sign head and a second end with a handgrip with a threaded portion; a second pole having a threaded connector at one end and a base at a second end, the threaded connector configured to be selectively secured to the threaded portion of the first pole, a battery disposed within the second pole; and, a switch disposed in the handgrip and configured to selectively provide and prohibit power flow from the battery to the light assemblies.

The switch may include a toggle switch having a first position, a second position, and a third position, wherein the toggle switch in the first position is configured to allow power to flow from the battery to the first pair of light assemblies, wherein the toggle switch in the second position is configured to allow power to flow from the battery through the second pair of light assemblies, and wherein the toggle switch in the third position is configured to prevent power from flowing to either the first or second pair of light assemblies. The portable, self-illuminating traffic sign may also include corresponding electrical connectors for selectively connecting the battery to the first and second pair of light assemblies. The first traffic sign comprises a stop sign and the first predominant color is red, and wherein the second traffic sign comprises a slow sign and the second predominant color is yellow/orange.

These and other aspects and embodiments of the present invention, which may be combined in any manner, will be appreciated by those of ordinary skill in the art based upon the following description of the drawings and detailed description of the preferred embodiments.

BRIEF DESCRIPTION OF THE DRAWINGS

The attached figures in the drawings will make it possible to understand how the invention can be produced. In these figures, similar reference numbers denote similar elements.

DETAILED DESCRIPTION

Figure 1:
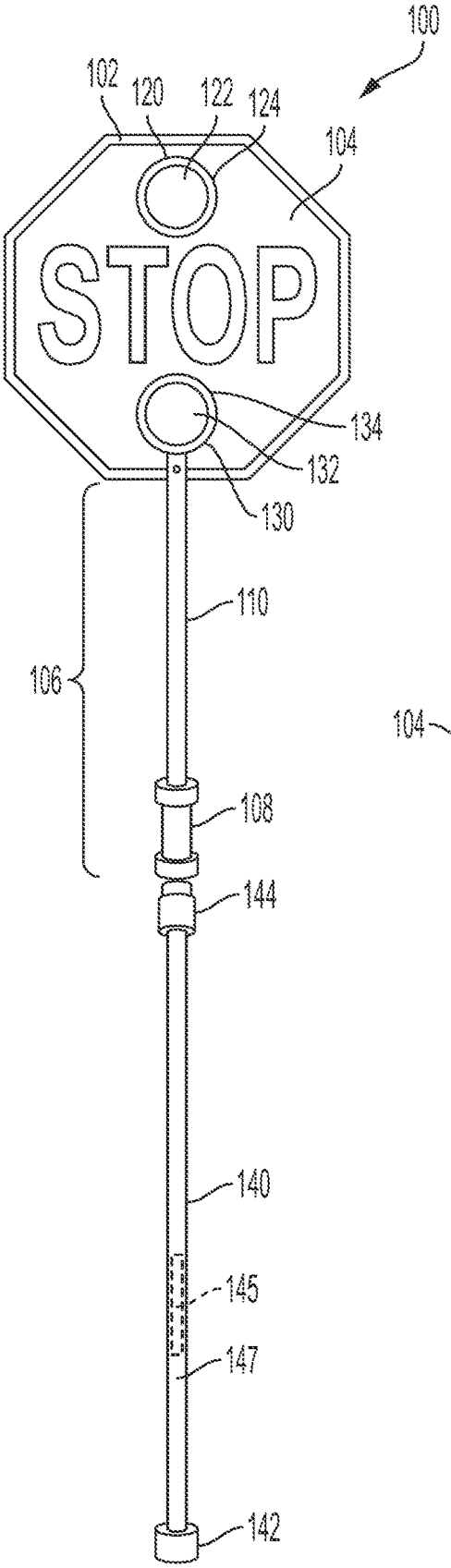
FIG. 1 is a perspective view of a first side of a portable, self-illuminating traffic sign according to one or more aspects of the present invention.

As mentioned above, a new hand-held traffic sign has been invented. The new sign is self-balancing with a battery inside a pole located near the lower base. A roll pin may be located approximately 10" from the bottom of the pole to keep the battery up high enough to be away from the elements (e.g., water, rain, snow, ice, etc.) but yet low enough in the sign assembly to distribute weight to create ease of balance and handling. The battery position is specific to allow for the correct length of power cord to attach into the sign handle assembly. The base at the bottom of the power stick protects the battery from the environment and is waterproof. The base is also designed to stabilize and balance the sign for ease of use and to reduce operator/flagger fatigue. The handle for the sign has two main purposes: (A) to quickly and easily assemble and disassemble the sign for ease of storage, transportation, portability, and charging; and (B) hold the power cord connector in the correct position so it is easily accessible to plug in and out to the sign head and charger. According to preliminary investigations, the battery life, depending on the temperature, can be approximately 40 hours long before charging is required.

The sign head is constructed in either a twenty-four inch (24") or eighteen inch (18") size sign head, both approved by Federal Highway Administration (FHWA) as set forth in the Manual on Uniform Traffic Control Devices (MUTCD). Four light bezels are mounted to the sign head above and below the "STOP" and "SLOW" lettering (e.g., two 4" yellow light emitting diode (LED) flashing lights on the "SLOW" side and two 4" red LED flashing lights on the "STOP" side). The speed of the light flashing should conform to the standards set forth in the MUTCD recommendations. Rubber grommets may be used through drilled holes in the sign to prevent any electrical shorts or damaged wires. The four LED lights use waterproof grommets to mount them to the bezels.

The LED wires for all of the LED lights are preferably only on one side of the sign head (e.g., the "SLOW" side of the sign head). The wires run down the sign face and are covered by a waterproof cosmetic appliqué.

The sign head may be connected to the sign pole in a design and fashion using the two lower bezels to support and allow the pole-to-head connection to be rigid and waterproof to protect the wires and electrical components. The sign head is constructed of a reflective material that conforms with standards and requirements set forth in the MUTCD.

The wires are inside the pole and follow the pole down to the handle and central wiring harness. As noted above, the handle has multiple functions. It connects the upper sign head and pole to the lower power stick making this flagger sign a "two-piece design." The threads of complimentary threaded portions have a high pitch for fast assembly of the two pieces. The handle may be a split two-piece design acting as a clamp to grip the upper sign head pole firmly and also has a hollow area inside to house the electronics includes the wiring and the three-way on-off-on rocker switch.

The three-way rocker switch is designed and fitted into the two-piece handle so it is flush and easy to use with one finger while grasping the pole handle. The three-way rocker allows for only one side of the sign to flash at a time, therein reducing confusion for traffic in both directions and for the flagger. The three-way rocker function allows for a "flash back" to the other flagger/co-worker in a one-way traffic situation and configuration where the flagger signs must be turned simultaneously. This aids the flaggers to both rotate their signs in one-way traffic configurations more safely and easily. No radios are required with this operation. The three-way rocker also has an "off" position to save battery life while not in use.

A "12-volt pigtail" is also included in the handle wiring harness so the LED lights can run off a 12-volt power supply, such as a vehicle's 12-volt socket. This will extend the life of the battery or operate the power of the sign if the batteries are unable. The pole handle is designed to comfortably fit an average hand grip and has an upper and lower ridge to keep the flagger in the appropriate area in a comfortable manner. This sign head is designed to operate in all weather conditions.

With this general description in mind, an exemplary embodiment will be described with the understanding that this description is not intended to be limiting.

Turning to FIG. 1, a portable, self-illuminating traffic sign 100 is shown which includes a sign head 102 having a first side 104. In the depicted embodiment, the first side 104 is a reflective panel having the coloring and markings corresponding to an American "STOP" sign. The sign head 102 is attached to a handle 106 having a handgrip 108 and a first pole 110 extending between the handgrip 108 and the sign head 102.

The sign head 102 additionally includes a first protrusion 120 having a first light assembly 122 disposed on a first collar 124 and a second protrusion 130 having a second light assembly 132 disposed on a second collar 134. As will be appreciated by those of ordinary skill in the art, a light assembly includes one or more light sources, necessary circuitry, a housing, and other protective structure, materials, and wiring to supply power to the light, The first collar 124 of the depicted embodiment has a cylindrical shape. Alternatively, the first collar 124 may be configured with another shape, for example one that is generally triangular, rectangular, pentagonal, etc.

Figure 2:
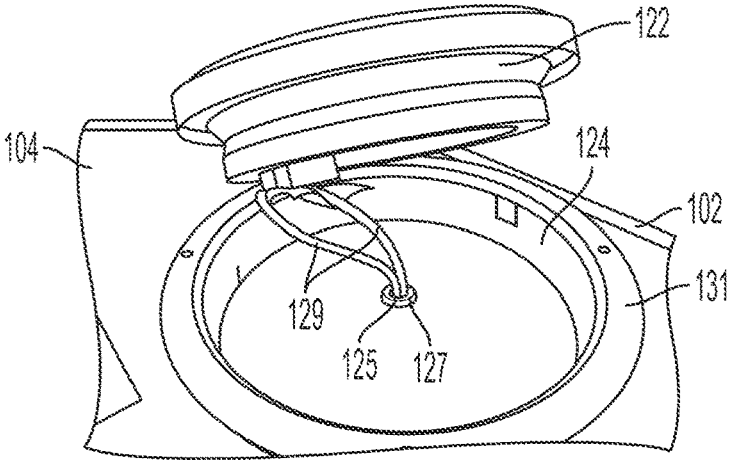
FIG. 2 is a top and front, partially unassembled view of a portion of the sign of FIG. 1.

Turning to FIG. 2, the first collar 124 is disposed on the first side 104 about an aperture 125 in the sign head 102. It is contemplated that the aperture 125 is centrally located with respect to the first collar 124, once the first collar 124 is installed on the sign head 102, but not required. A rubber or other nonconductive grommet 127 is installed in the aperture 125 to safely convey electrical wires 129 to a second side 202 (see FIG. 3) of the sign head 102 from the first side 104.

By using the collar 124, the present invention reduces or prevents light from the first light assembly 122 shining backward onto the first side 104 of the sign head 102 (which would create a glare that would reduce the ability of a person approaching from being able to read the sign head 102).

As can be seen in FIG. 2, the first light assembly 122 is disposed on an outermost edge 131 of the collar 124. The outermost edge 131 is the edge of the collar 124 furthest from the sign head 102. The first light assembly 122 can alternatively be disposed at any point along the height of the collar 124 (measured from the sign head 102 to the outermost edge 131). For example, the first light assembly 122 may be slightly offset (i.e., ⅛ inch) from the end of the collar 124.

However, as indicated it is preferred that the first light assembly 122 (or any other light assembly herein) is disposed on the outermost edge of the collar to increase the visibility of the light being emitted from the light assembly. Furthermore, it is contemplated that the light emitted from the first light assembly 122 is viewable at an angle greater than 15, or 20, up to 60.

A qualitative comparison between a sign with light assemblies at the outermost edge of the collar and a sign with light assemblies located closer to the sign was conducted. As indicated in the below TABLE 1, not only did the present light assembly (located at the outermost edge) light over a greater range of angles, but the intensity of the light was greater as well.

TABLE 1

| Present Light Angle (from center) | Intensity (estimated amount of light viewed) | Comparative Light Angle (from center) | Intensity (estimated amount of light viewed) |
|---|---|---|---|
| 0° | 100% | 0° | 100% |
| 45° | 100% | 20° | ~50% |
| 70° | 100% | 32° | ~15% |
| 87° | >75% | 40° | 0 |

Returning to FIG. 1, the first light assembly 122, when in operation, emits a light corresponding to a color matching the predominant coloring of the first side 104. For example, the first light assembly 122 as shown in FIG. 1 emits a red light to match the red predominant in an American stop sign. In an alternative, the first light assembly 122 may emit a white light, or any color of light that corresponds to the first side 104. Additionally, by predominant color, it is meant that the color is at least 50% of the surface which contains the traffic signal.

Any light source can be included in the first light assembly 122. While LEDs are a preferred light source for the sign 100, other types of light sources are also acceptable including incandescent lights, halogens, fluorescents, etc. Any light source typically able to be seen over long distances may be an acceptable alternative. Additionally, the color of the light emitted by the light source of the first light assembly 122 may be directly from the LEDs or the color of the light may be a result of the light passing through a translucent cover of the light assembly 122, wherein the color of the cover provides the light with the desired color.

Moving to the second protrusion 130, the second light assembly 132, and the second collar 134 shown in FIG. 1, those are arranged similarly to the first protrusion 120, the first light assembly 122, and the first collar 124. Thus, although not depicted as such, the second protrusion 130 additionally includes an aperture and rubber grommet for passing electrical wires through the sign head 102. Accordingly, the above portion of the present description discussing FIG. 2 is incorporated herein by reference mutatis mutandis.

Also shown in FIG. 1, the present traffic sign 100 further includes a second pole 140 with a base 142 disposed on one end of the second pole 140. A threaded connector 144 is disposed on the other end of the second pole 140. The second pole 140 attaches to the handle 106 via the threaded connector 144. The threaded connector 144 is described in further detail in FIG. 6.

The second pole 140 includes a battery 145 retained within the second pole 140. For example, the battery 145 may be a lithium-ion battery or other rechargeable battery. The battery 145 is preferably retained at least ten (10) inches off the ground to ensure the power source is kept from interacting with anything harmful or damaging that may get into the second pole 140 (e.g., water). As a result, the second pole 140 includes a roll pin or similar structure 147 to maintain the battery 145 above the base 142.

The traffic sign 100 as shown in FIG. 1 may be between approximately five feet and six inches and seven feet and six inches from base 142 to the top of the sign head 102. The second pole 140 may be approximately four feet long. The portable, self-illuminating traffic sign 100 is designed to be both ergonomically arranged for user comfort and visibility for vehicle drivers. As a result, the length of the second pole 140 and the portable, self-illuminating traffic sign 100 may be arranged to maximize the ergonomics and visibility of the portable, self-illuminating traffic sign 100. As will be appreciated, these lengths and sizes are merely exemplary.

The base 142 supports the weight of the portable, self-illuminating traffic sign 100 such that a person would not need to hold the sign for extending periods of time. Additionally, the base 142 and the battery 145 act to stabilize the present traffic sign 100 to decrease the effort required to keep the sign upright. As a result, a person holding the sign 100 may not need to expend as much effort preventing the sign 100 from tipping.

Figure 3:
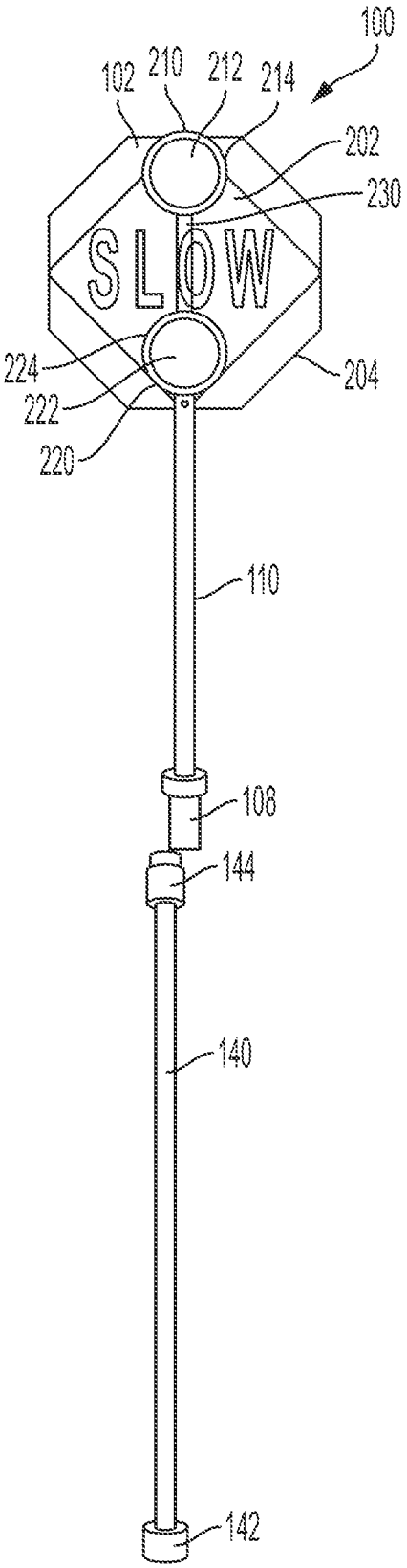
FIG. 3 is a perspective view of the second side of the sign of FIG. 1.

Turning to FIG. 3, a second side 202, opposite the first side 104, of the sign head 102 is shown. The second side 202 is made of a reflective panel having the coloring and markings corresponding to an American "SLOW" sign. The second side 202 may include a non-reflective border 204 around the "SLOW" sign to create the appearance of the traditional rectangular "SLOW" sign instead of an octagonal sign corresponding to the American "STOP" sign on the first side 104 (see FIG. 1).

The second side 202 additionally includes a third protrusion 210 having a third light assembly 212 and a third collar 214. The second side 202 further includes a fourth protrusion 220 having a fourth light assembly 222 and a fourth collar 224. The third protrusion 210 and the fourth protrusion 220 are arranged and constructed similarly to the first protrusion 120 and the second protrusion 130 as discussed above. Thus, the above portion of the present description is incorporated herein by reference here mutatis mutandis.

Since the second side 202 is a "SLOW" sign, the predominant color of the second side 202 is yellow/orange. As a result, the third light assembly 212 and the fourth light assembly 222 will preferably emit yellow/orange light. Apart from the color of the light, these assemblies 212, 222 are generally the same as those discussed above, and thus the above portion of the present description is incorporated herein by reference here mutatis mutandis.

Figure 4:
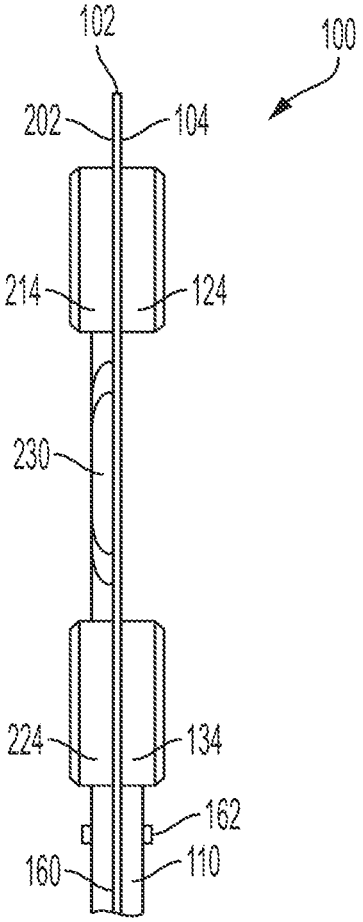
FIG. 4 is a side view of the sign of FIG. 1.

As can be seen in both FIGS. 3 and 4, extending between the third protrusion 210 and the fourth protrusion 220 is a cap 230. The cap 230 may be a U- or C-shaped channel. As shown in FIG. 2, the wires 129 for the first light assembly 122 extend through the aperture 125 to the second side 202 of the sign head 102, and more specifically, into the third collar 214. Although not shown, these wires 129, along with the wires for the third light assembly 212 pass to the fourth collar 224 from the third collar 214 under the cap 230. The cap 230 may be made of a reflective material and includes the colors and markings of the second side 202. As a result, the cap 230 is less likely to distract a motorist.

As shown in FIG. 4, the sign head 102 is made of a single reflective panel. Accordingly, a thickness of the sign head 102 (distance between the two sides 104, 202) corresponds to the thickness of the single reflective panel. As a result, the present traffic sign 100 is thinner and often lighter in weight than signs that include two panels having a space between them.

Additionally, as can be seen in FIG. 4, the sign head 102 sits in a channel 160 in the first pole 110 and is held by a fastener 162 such as a screw or pin. As noted above, the depth of the channel 160 may depend on a distance from a lower edge of the sign head 102 to the second and fourth collars 134, 224. Thus, the second and fourth collars 134, 224 may sit on an upper end of the first pole 110.

Figure 5:
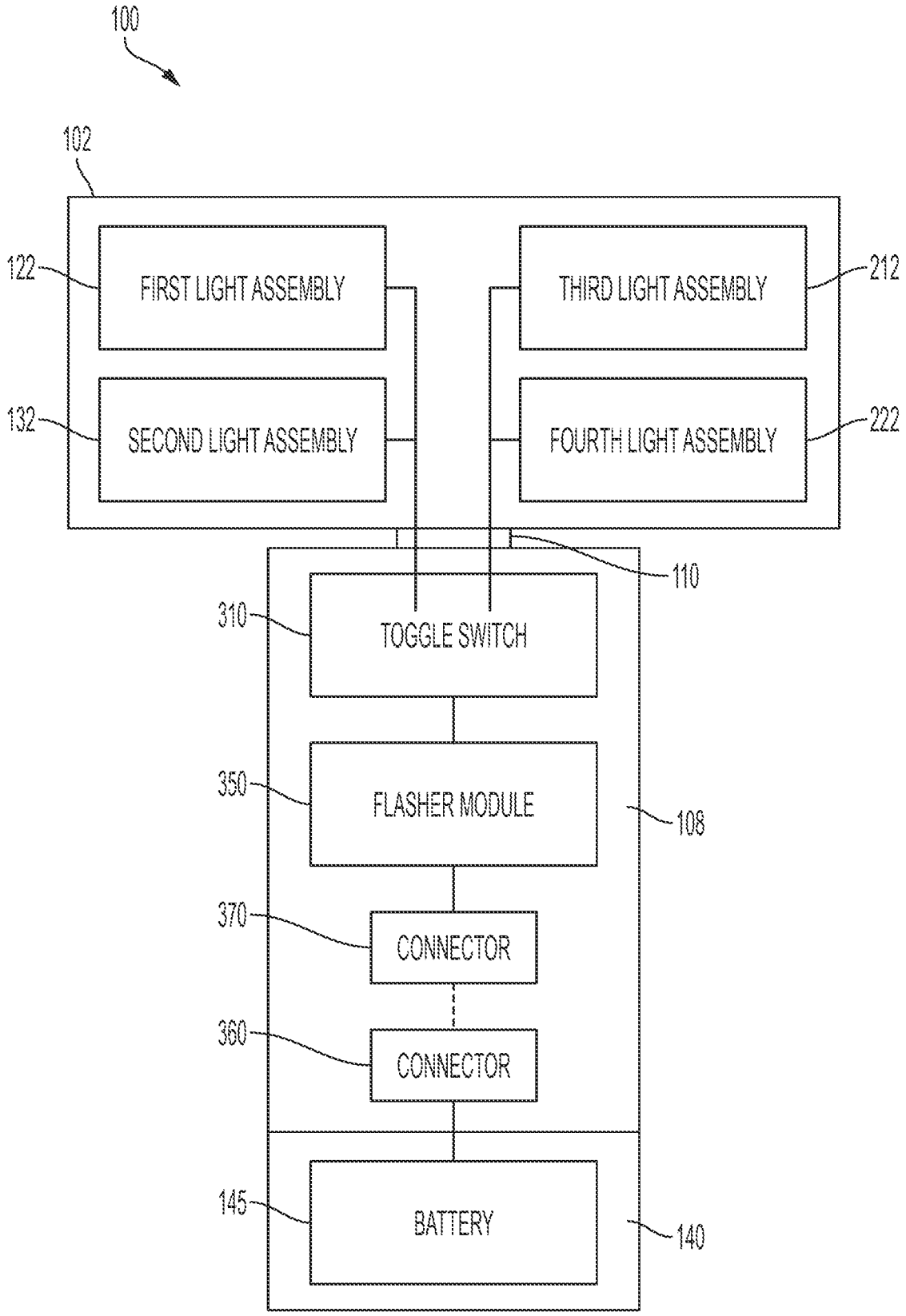
FIG. 5 is a schematic diagram of the sign of FIG. 1.

Turning to FIG. 5, the electrical wiring of the present traffic sign 100 is shown. Specifically, each of the light assemblies 122, 132, 212, 222 are connected to a toggle switch 310. The toggle switch 310 selectively provides power to the lights of the light assemblies 122, 132, 212, 222 from the battery 145 in the second pole 140. The switch 310 may selectively provide power to the light assemblies 122, 132, 212, 222 to one or both sides 104, 202 of the sign head 102.

As discussed above, it is preferred that the toggle switch 310 is a three-position switch. Accordingly, in a first position, the toggle switch 310 activates the first light assembly 122 and the second light assembly 132 on the first side 104 of the sign 100. In a second position, the toggle switch activates the third light assembly 212 and the fourth light assembly 222 of the second side 202 of the sign 100. In the third position of the toggle switch 320, none of the light assemblies 122, 132, 212, 222 are activated (i.e., the sign 100 is off).

In some examples, activating the light assemblies 122, 132, 212, 222 includes the light assemblies 122, 132, 212, 222 emitting a steady light. Alternatively, when the light assemblies 122, 132, 212, 222 are activated, they may emit light intermittently (i.e. flash). In such examples, the light assemblies 122, 132, 212, 222 preferably flash approximately sixty (60) times per minute. Accordingly, a flasher control module 350 is included in the handgrip 108 of the handle 106. For example, the flasher control module 350 may be an LED flasher relay.

In use, the sign 100 is typically powered by the battery 145. However, in some instances, a different power source could be used. The power source could be external such as a power system of a car, truck, or portable generator. Accordingly, corresponding electrical connectors 360, 370 are provided for selectively establishing electrical connection between the battery 145 and the light assemblies 122, 132, 212, 222. However, as noted above, it is contemplated that the sign 100 is sometimes powered from a power source other than the battery 145. Thus, the connection between the electrical connectors 360, 370 may be broken and the connector 370 may be connected to another power source. Additionally, the battery 145 may be charged by connecting its electrical connector 360 to a power source, such as a 12 v automotive accessory outlet in a vehicle or in a household 110 v outlet.

Figure 6:
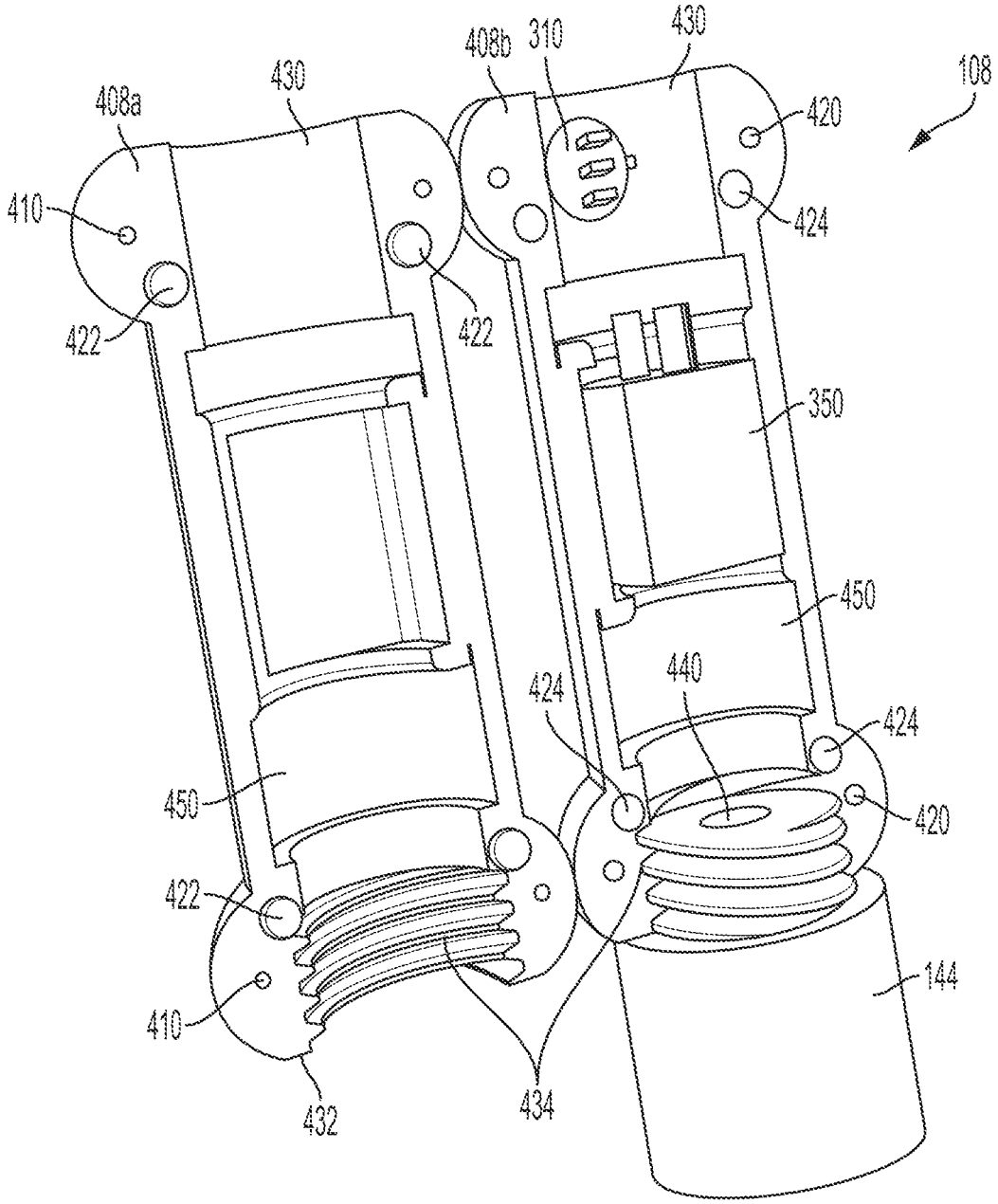
FIG. 6 is a perspective, unassembled view of a handgrip from the sign of FIG. 1.

Turning to FIG. 6, the handgrip 108 is shown as having a first part 408*a* and a second part 408*b*. The first and second parts 408*a*, 408*b* may be held together with fasteners (not shown) which, as would be appreciated, may pass through apertures 410 in one of the two parts 408*a*, 408*b* and into blind holes 420 in the other of the two parts 408*a*, 408*b*. Additionally, the parts 408*a*, 408*b* of the handgrip 108 may include complementary configured positioning means, such as protrusions 422 and indents 424. The complementary configured positioning means ensure that the two parts 408*a*, 408*b* are positioned correctly when the handgrip 108 is fastened together.

A first end 430 of the handgrip 108 may be coupled to the first pole 110 (FIG. 1) by a clamp fit and, optionally, an adhesive. As shown in FIG. 6, the handgrip 108 also includes a second end 432 with a threaded portion 434 to receive the threaded connector 144 of the second pole 140 (See, FIGS. 1 and 3). An aperture 440 in the threaded connector 144 allows for wires (not shown) from the battery 145 to terminate in the electrical connector 360 (FIG. 5). Once connected to provide electrical communication, the electrical connectors 360, 370 (FIG. 5) may be positioned in a cavity 450 within the handgrip 108. Additionally, the toggle switch 310 and the flasher module 350 may be held within the handgrip 108.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A portable, self-illuminating traffic sign comprising:

a sign head having at least one side;

a first collar extending from the at least one side of the sign head; and a first light assembly disposed on the first collar;

wherein an intensity of light emitted by the first light assembly, when viewed at an angle of 45 degrees from a line extending orthogonally from the at least one side of the sign head, is 100%.

2. The portable, self-illuminating traffic sign of claim 1, wherein the intensity of light emitted by the first light assembly, when viewed at an angle of 70 degrees from the line that extends orthogonally from the at least one side of the sign head, is 100%.

3. The portable, self-illuminating traffic sign of claim 1, wherein the intensity of light emitted by the first light assembly, when viewed at an angle of 87 degrees from the line that extends orthogonally from the at least one side of the sign head, is greater than 75%.

4. The portable, self-illuminating traffic sign of claim 1, further comprising:

a handle attached to the sign head.

5. The portable, self-illuminating traffic sign of claim 4, wherein the at least one side of the sign head has a second light assembly.

6. The portable, self-illuminating traffic sign of claim 5, wherein the handle has a switch configured to selectively activate the first light assembly, the second light assembly, or both.

7. The portable, self-illuminating traffic sign of claim 1, further comprising:

a switch configured to selectively activate the first light assembly.

8. The portable, self-illuminating traffic sign of claim 1, wherein the at least one side of the sign head comprises a stop sign.

9. The portable, self-illuminating traffic sign of claim 1, wherein the at least one side of the sign head comprises a slow sign.

10. The portable, self-illuminating traffic sign of claim 1, wherein the at least one side of the sign head has at least two collars.

11. The portable, self-illuminating traffic sign of claim 10, wherein a first of the at least two collars is disposed above the second of the at least two collars.

12. The portable, self-illuminating traffic sign of claim 10, wherein a first of the at least two collars is disposed above a word on the at least one side and the second of the at least two collars is disposed below the word.

13. The portable, self-illuminating traffic sign of claim 1, wherein the at least one collar comprises an outermost edge furthest from the at least one side of the sign head.

14. The portable, self-illuminating traffic sign of claim 13, wherein the at least one light assembly is disposed on the outermost edge of the at least one collar.

15. The portable, self-illuminating traffic sign of claim 1, wherein the at least one side of the sign head comprises a first side with a first traffic sign and a second side with s second traffic sign different from the first traffic sign.

16. The portable, self-illuminating traffic sign of claim 15, wherein the first traffic sign comprises a stop sign and the second traffic sign comprises a slow sign.

17. A reflective panel comprising:

at least one side;

a first collar extending from the at least one side of the panel; and a first light assembly disposed on the first collar;

wherein the at least one side has a color for visually indicating a traffic signal;

wherein an intensity of light emitted by the first light assembly, when viewed at an angle of 45 degrees from a line extending orthogonally from the center of the at least one side, is 100%.

18. The reflective panel of claim 17, wherein an intensity of light emitted by the first light assembly, when viewed at an angle of 70 degrees from the line that extends orthogonally from the center of the at least one side, is 100%.

19. The reflective panel of claim 18, wherein an intensity of light emitted by the first light assembly, when viewed at an angle of 87 degrees from the line that extends orthogonally from the center of the at least one side, is greater than 75%.

20. A reflective panel comprising:

a first side and a second side;

a first collar and a second collar extending from the first side; and, a third collar and a fourth collar extending from the second side, wherein the first side has a first color for visually indicating a first traffic signal and wherein the second side has a second color for visually indicating a second traffic signal, wherein each collar comprises a light assembly, wherein an intensity of light emitted by the light assemblies of the first color and the second collar, when viewed at an angle of 45 degrees from a line extending orthogonally from the first side, is 100%, and wherein an intensity of light emitted by the light assemblies of the third collar and the fourth collar, when viewed at an angle of 45 degrees from a line extending orthogonally from the second side, is 100%.

* * * * *